US009673523B2

(12) United States Patent
Veysoglu et al.

(10) Patent No.: US 9,673,523 B2
(45) Date of Patent: Jun. 6, 2017

(54) SYSTEMS AND METHODS FOR INTERFERENCE GEOLOCATION AND MITIGATION USING A PHASED ARRAY RECEIVING ANTENNA

(71) Applicant: The Boeing Company, Seal Beach, CA (US)

(72) Inventors: Murat E. Veysoglu, Cypress, CA (US); Keith Jarett, Lafayette, CA (US); Raenaurd D. Turpin, La Mirada, CA (US)

(73) Assignee: The Boeing Company, Chicago, IL (US)

( * ) Notice: Subject to any disclaimer, the term of this patent is extended or adjusted under 35 U.S.C. 154(b) by 917 days.

(21) Appl. No.: 14/027,366

(22) Filed: Sep. 16, 2013

(65) Prior Publication Data

US 2015/0077290 A1 Mar. 19, 2015

(51) Int. Cl.

*H01Q 3/26* (2006.01)
*H01Q 3/30* (2006.01)
*H01Q 3/00* (2006.01)

(52) U.S. Cl.

CPC ..... *H01Q 3/2611* (2013.01); *H01Q 3/2605* (2013.01)

(58) Field of Classification Search

CPC ..... H01Q 3/26; H01Q 3/2605; H01Q 3/2611; H01Q 3/2658; H01Q 3/44; H01Q 3/46; G01S 7/02; G01S 7/28; G01S 7/2813; G01S 7/35; G01S 7/36; G01S 7/285; G01S 7/292; G01S 7/2923; G01S 7/2928; H04B 7/02; H04B 7/04; H04B 7/08; H04B 7/0837;

(Continued)

(56) References Cited

U.S. PATENT DOCUMENTS 4,189,733 A * 2/1980 Malm ..... H04B 7/0851 342/368
4,364,052 A * 12/1982 Ohm ..... H01Q 3/2658 343/781 CA (Continued)

FOREIGN PATENT DOCUMENTS

EP 2717066 A1 4/2014

OTHER PUBLICATIONS

Zoltowki, M. et al.; Closed-Form 2-D Angle Estimation with Rectangular Arrays in Element Space or Beamspace via Unitary ESPRIT; IEEE Transaction on Signal Processing; Feb. 1996; pp. 316-328; vol. 44, No. 2; IEEE.

(Continued)

*Primary Examiner* — Bernarr Gregory
(74) *Attorney, Agent, or Firm* — Armstrong Teasdale LLP

(57) ABSTRACT

A method for mitigating interference using a phased array receiving antenna is provided. The method includes perturbing a first communications beam and a second communications beam received at the phased array receiving antenna to generate a first composite beam and a second composite beam, cross-correlating the first composite beam and the second composite beam, receiving communications data using the first composite beam and the second composite beam, and determining a direction of a received interference signal based on the cross-correlation of the first composite beam and the second composite beam.

20 Claims, 6 Drawing Sheets

(58) Field of Classification Search
CPC .. H04B 7/0842; H04B 7/0848; H04B 7/0854; H04B 7/0851
USPC ..... 342/378–384
See application file for complete search history.

(56) References Cited

U.S. PATENT DOCUMENTS 4,937,584 A * 6/1990 Gabriel ..... G01S 7/2813 342/154
5,021,793 A 6/1991 Stangel et al.
5,371,506 A * 12/1994 Yu ..... G01S 7/36 342/149
5,515,060 A * 5/1996 Hussain ..... H01Q 3/46 342/157
5,844,521 A 12/1998 Stephens et al.
6,417,799 B1 7/2002 Aubain et al.
7,352,721 B2 * 4/2008 Kim ..... H01Q 3/2605 370/334
7,453,398 B2 * 11/2008 Rouzeaud ..... G01S 7/2813 342/196
7,751,854 B2 7/2010 Leifer et al.
7,825,857 B2 11/2010 Lackey et al.
8,004,459 B2 8/2011 Ho et al.
8,412,126 B2 4/2013 Karabinis et al.
8,614,644 B2 * 12/2013 Dybdal ..... G01S 7/2813 342/379
2011/0075601 A1 3/2011 Zheng

OTHER PUBLICATIONS

Godara, L; Application of Antenna Arrays to Moble Communications, Part II; Beam-Forming and Direction-of-Arrival Considerations; Proceedings of the IEEE; Aug. 1997; pp. 1195-1245; vol. 85, No. 8; IEEE.
Search Report, Application No. GB1415920.6, dated Feb. 27, 2015, pp. 3.

* cited by examiner

SYSTEMS AND METHODS FOR INTERFERENCE GEOLOCATION AND MITIGATION USING A PHASED ARRAY RECEIVING ANTENNA

BACKGROUND

The present disclosure relates generally to managing interference using an adjustable phased array antenna, and more particularly to systems and methods for locating the source of and mitigating the effects of interference using an adjustable phased array antenna.

Antenna arrays can be used to estimate the direction-of-arrival (DOA) of incoming signals employing one or more signal processing algorithms. These methods measure and process received signals to determine the direction-of-arrival information. In one class of approaches for geolocation, known as beamspace processing, the signal processing is formed after beamforming. Existing beamspace processing approaches are either noncoherent or coherent. In noncoherent geolocation one or two antenna beams point near but not directly at the direction of an interferer. This can be accomplished by a spiral scan or grid scan. A gain slope of the antenna pattern provides directional sensitivity. Coherent geolocation uses two or more antenna beams pointed in different directions. A phase difference between interferer signals received in the two antenna beams reveals one angle of arrival. Repeating this process for north-south and east-west separated beam centers reveals the complete direction of arrival from the interferer. Both of these approaches interrupt communication service in the beams employed. Noncoherent geolocation is relatively slow, requiring movement of the beam centers. Coherent geolocation is faster and more accurate than noncoherent geolocation but it still requires pre-emption (i.e., interruption) of communication service.

Given that known geolocation systems currently require dedication of one or more receiving antenna beam, thereby removing the beam or beams from communication service, a system that enables geolocation to be performed while allowing communication service to continue would be beneficial.

BRIEF DESCRIPTION

In one aspect, a method for mitigating interference using a phased array receiving antenna is provided. The method includes perturbing a first communications beam and a second communications beam received at the phased array receiving antenna to generate a first composite beam and a second composite beam, cross-correlating the first composite beam and the second composite beam, receiving communications data using the first composite beam and the second composite beam, and determining a direction of a received interference signal based on the cross-correlation of the first composite beam and the second composite beam.

In another aspect, a communications satellite comprising a phased array receiving antenna is provided. The communications satellite is configured to perturb a first communications beam and a second communications beam received at the phased array receiving antenna to generate a first composite beam and a second composite beam, cross-correlate the first composite beam and the second composite beam, receive communications data using the first composite beam and the second composite beam, and determine a direction of a received interference signal based on the cross-correlation of the first composite beam and the second composite beam.

In another aspect, a non-transitory computer-readable medium having computer-executable instructions embodied thereon is provided. When executed by a communications satellite comprising a phased array receiving antenna and at least one processor in communication with the phased array receiving antenna, the computer-executable instructions cause the communications satellite to perturb a first communications beam and a second communications beam received at the phased array receiving antenna to generate a first composite beam and a second composite beam, cross-correlate the first composite beam and the second composite beam, receive communications data using the first composite beam and the second composite beam, and determine a direction of a received interference signal based on the cross-correlation of the first composite beam and the second composite beam.

DETAILED DESCRIPTION

Figure 1:
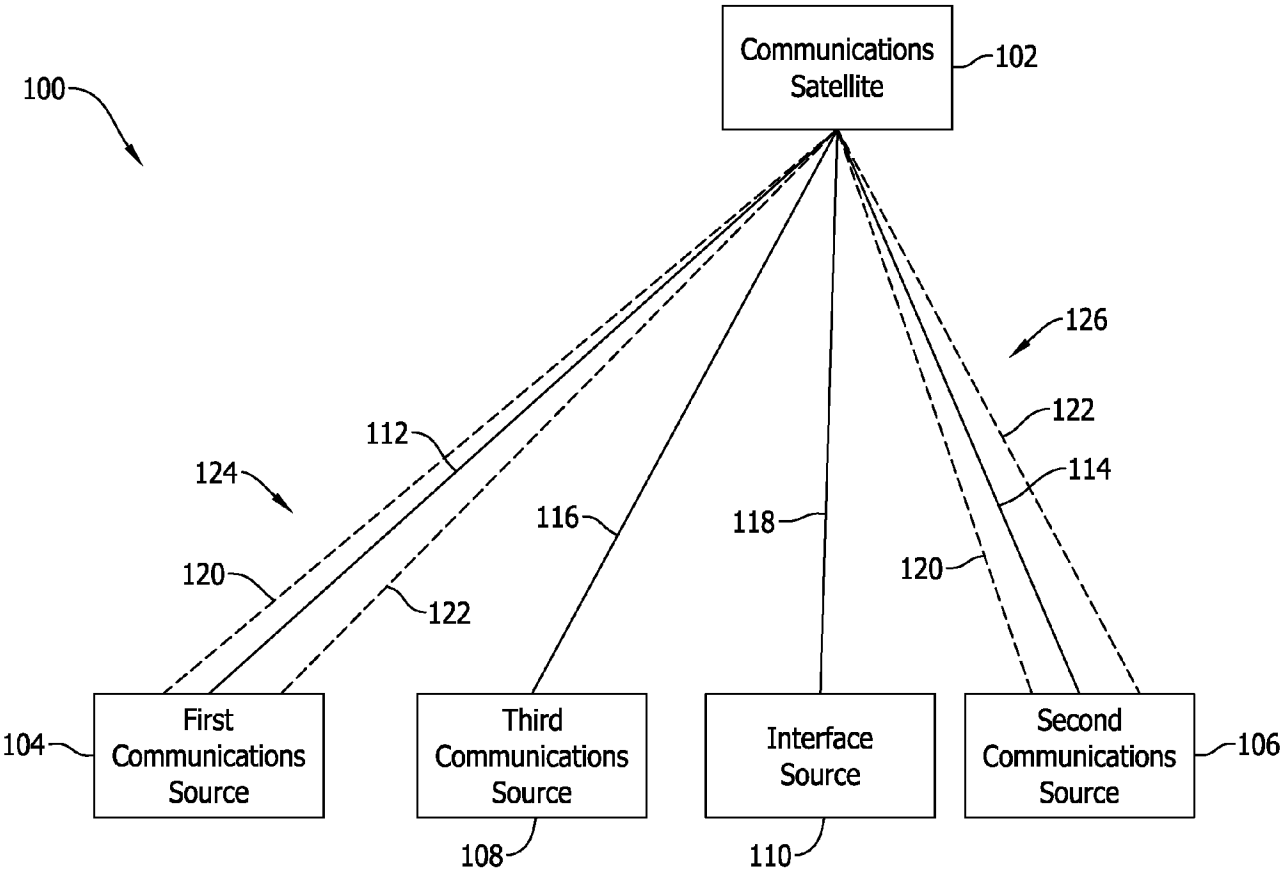
FIG. 1 is a simplified block diagram of an example environment including a communications satellite, multiple communications sources, and an interference source.

FIG. 1 is a simplified block diagram of an example environment 100 including a communications satellite 102, a first communications source 104, a second communications source 106, a third communications source 108, and an interference source 110. Communications satellite 102 operates in a receiving mode and receives communication data in a communications beam 112 from first communications source 104, a second communications beam 114 from second communications source 106, and a third communications beam 116 from third communications source 108. First communications source 104, second communications source 106, and third communications source 108 may be, for example, ground-based transmitters. Interference source 110 transmits an interference signal 118 that is received by communications satellite 102. In order to mitigate the interference, for example by locating the direction-of-arrival of interference signal 118 and geolocating interference source 110, communications satellite 102 generates a first sub-beam 120 and a second sub-beam 122. Taken together, first communications beam 112 and first sub-beam 120 form a first composite beam 124. Additionally, second communications beam 114 and second sub-beam 122 form a second composite beam 126. More specifically, first composite beam 124 is a superposition of first communications beam 112 and first sub-beam 120 and second composite beam 126 is a superposition of second communications beam 114 and second sub-beam 122. As described herein, by cross-correlating first composite beam 124 and second composite beam 126, communications satellite 102 may determine a direction of interference signal 118 and determine the location of ("geolocate") interference source 110, while continuing to receive communications data at least from first communications source 104, second communications source 106, and third communications source 108.

Figure 2:
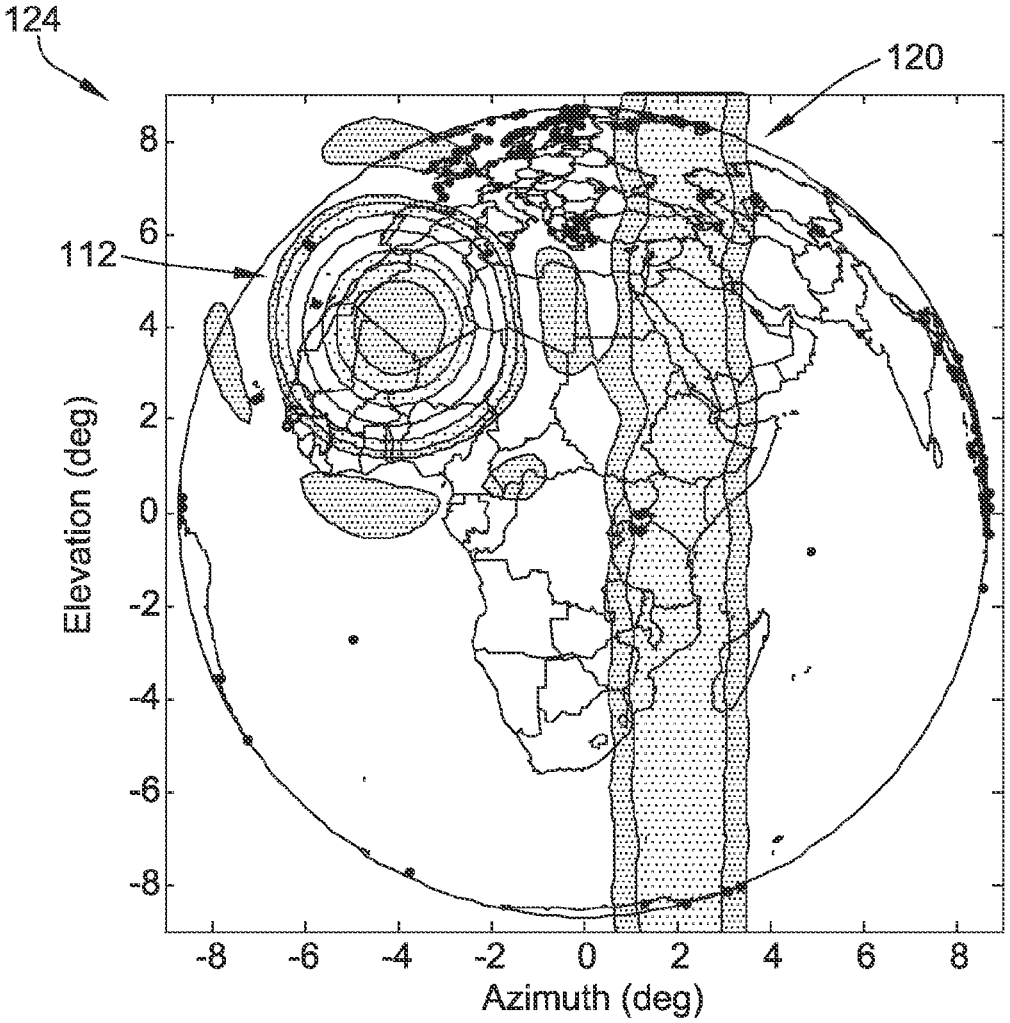
FIG. 2 is a diagram of an example communications beam and an example sub-beam that are included in an example composite beam.

FIG. 2 is a diagram of first communications beam 112 and first sub-beam 120 from a different perspective than in FIG. 1. First communications beam 112 covers a substantially circular area and is focused on a particular geographic region, whereas sub-beam 120 is distributed across a strip of geographic area. Both communications beam 112 and sub-beam 120 are included in first composite beam 124.

Figure 3:
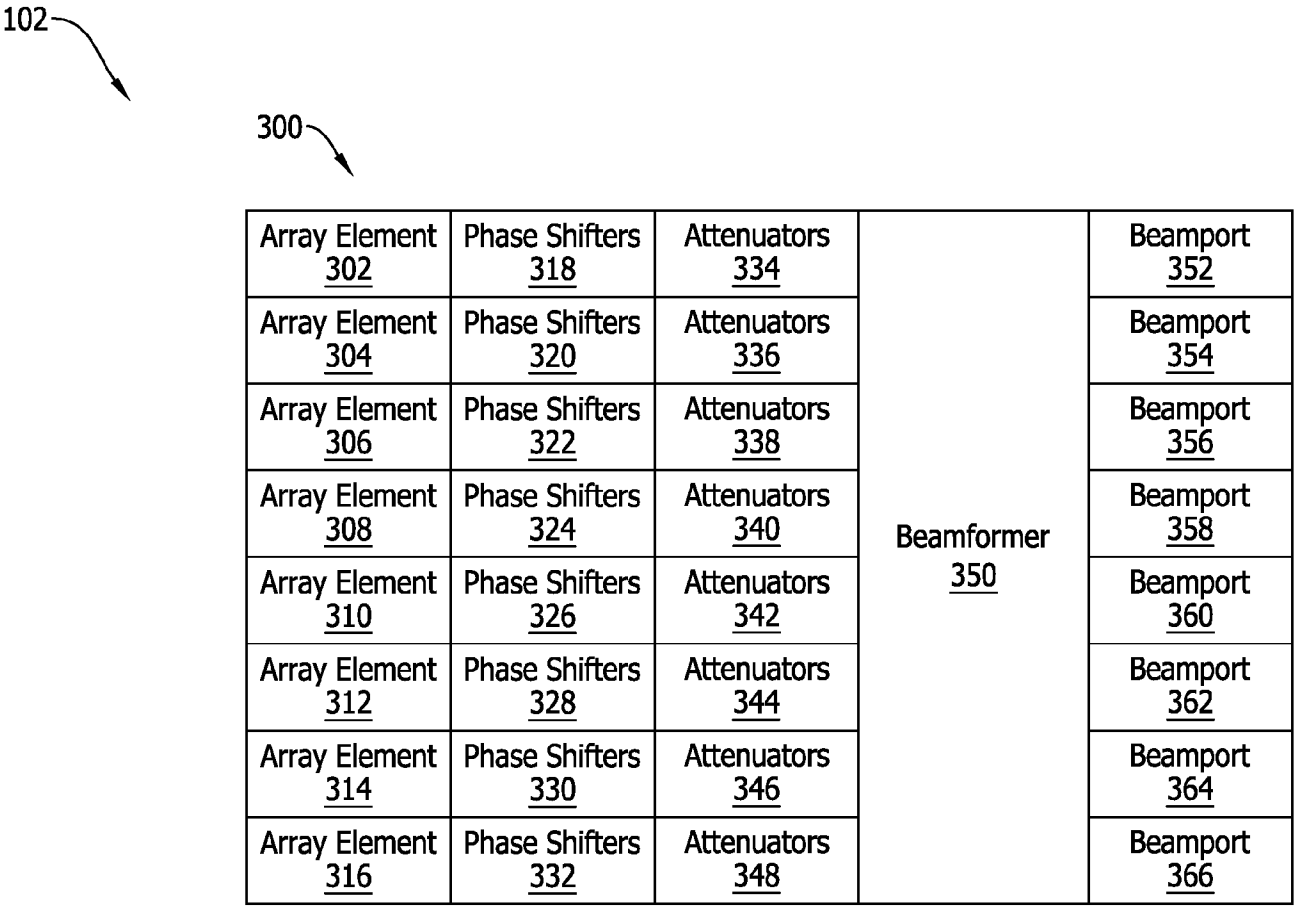
FIG. 3 is a block diagram of components of the communications satellite of FIG. 1.

FIG. 3 is a block diagram of components of communications satellite 102. FIG. 3 may be considered a side view of communication satellite 102. It should be understood that communication satellite 102 may include additional components that are not described or shown. Communications satellite 102 includes a phased array receiving antenna 300. More specifically, phased array receiving antenna is programmable or adjustable to selectively receive signals or beams from various directions and/or sources. Phased array receiving antenna 300 includes array elements 302, 304, 306, 308, 310, 312, 314, and 316. Array elements 302, 304, 306, 308, 310, 312, 314, and 316 receive electromagnetic radiation transmitted from one or more sources, for example first communication source 104, second communication source 106, third communication source 108 and/or interference source 110. Coupled to array elements 302, 304, 306, 308, 310, 312, 314, and 316 are corresponding phase shifters 318, 320, 322, 324, 326, 328, 330, and 332 and corresponding attenuators 334, 336, 338, 340, 342, 344, 346, and 348. A beamformer 350 is operatively coupled to phase shifters 318, 320, 322, 324, 326, 328, 330, and 332 and attenuators 334, 336, 338, 340, 342, 344, 346, and 348 and transmits control signals thereto to adjust the phase and/or magnitude of received electromagnetic radiation and form one or more corresponding beams. Each beam is received in a corresponding beamport 352, 354, 356, 358, 360, 362, 364, and 366, which is included in or coupled to beamformer 350. In implementations in which beamformer 350 is analog, the number of beamports 352, 354, 356, 358, 360, 362, 364, and 366 is limited by hardware. In implementations in which beamformer 350 is not analog, the number of beamports 352, 354, 356, 358, 360, 362, 364, and 366 is not limited by the hardware. The processes described herein may be implemented with an analog or a non-analog (e.g., digital) beamformer 350.

Figure 4:
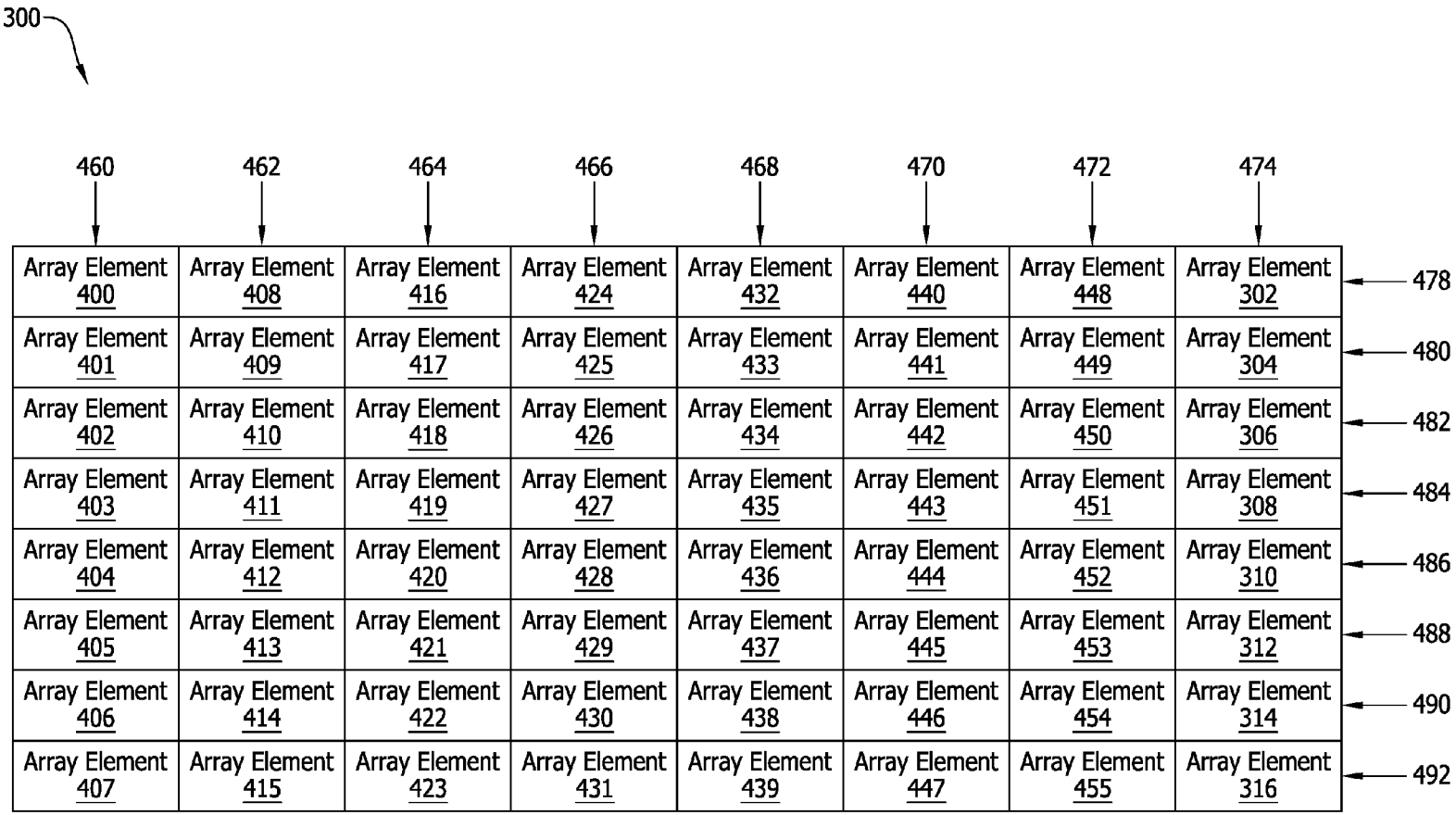
FIG. 4 is a block diagram of antenna elements in a phased array receiving antenna of the satellite of FIG. 1.

FIG. 4 is a block diagram of phased array receiving antenna 300. FIG. 4 may be considered a front view of phased array receiving antenna 300. In addition to array elements 302, 304, 306, 308, 310, 312, 314, and 316, which are also shown in FIG. 3, phased array receiving antenna 300 additionally includes array elements 400-455. Array elements 400-407, 415-316, 302-314, and 408-448 form a periphery of phased array receiving antenna 300. Array elements 400-407 form a first column 460. Array elements 408-415 form a second column 462. Array elements 416-423 form a third column 464. Array elements 424-431 form a fourth column 466. Array elements 432-439 form a fifth column 468. Array elements 440-447 form a sixth column 470. Array elements 448-455 form a seventh column 472, and array elements 302-316 form an eighth column 474. Additionally, array elements 400, 408, 416, 424, 432, 440, 448, and 302 form a first row 478. Array elements 401, 409, 417, 425, 433, 441, 449, and 304 form a second row 480. Array elements 402, 410, 418, 426, 434, 442, 450, and 306 form a third row 482. Array elements 403, 411, 419, 427, 435, 443, 451, and 308 form a fourth row 484. Array elements 404, 412, 420, 428, 436, 444, 452, and 310 form a fifth row 486. Array elements 405, 413, 421, 429, 437, 445, 453, and 312 form a sixth row 488. Array elements 406, 414, 422, 430, 438, 446, 454, and 314 form a seventh row 490, and array elements 407, 415, 423, 431, 439, 447, 455, and 316 form an eighth row 492. In some implementations, phased array receiving antenna 300 is not square or rectangular in shape. For example, in implementations, phased array receiving antenna 300 is circular in shape.

Figure 5:
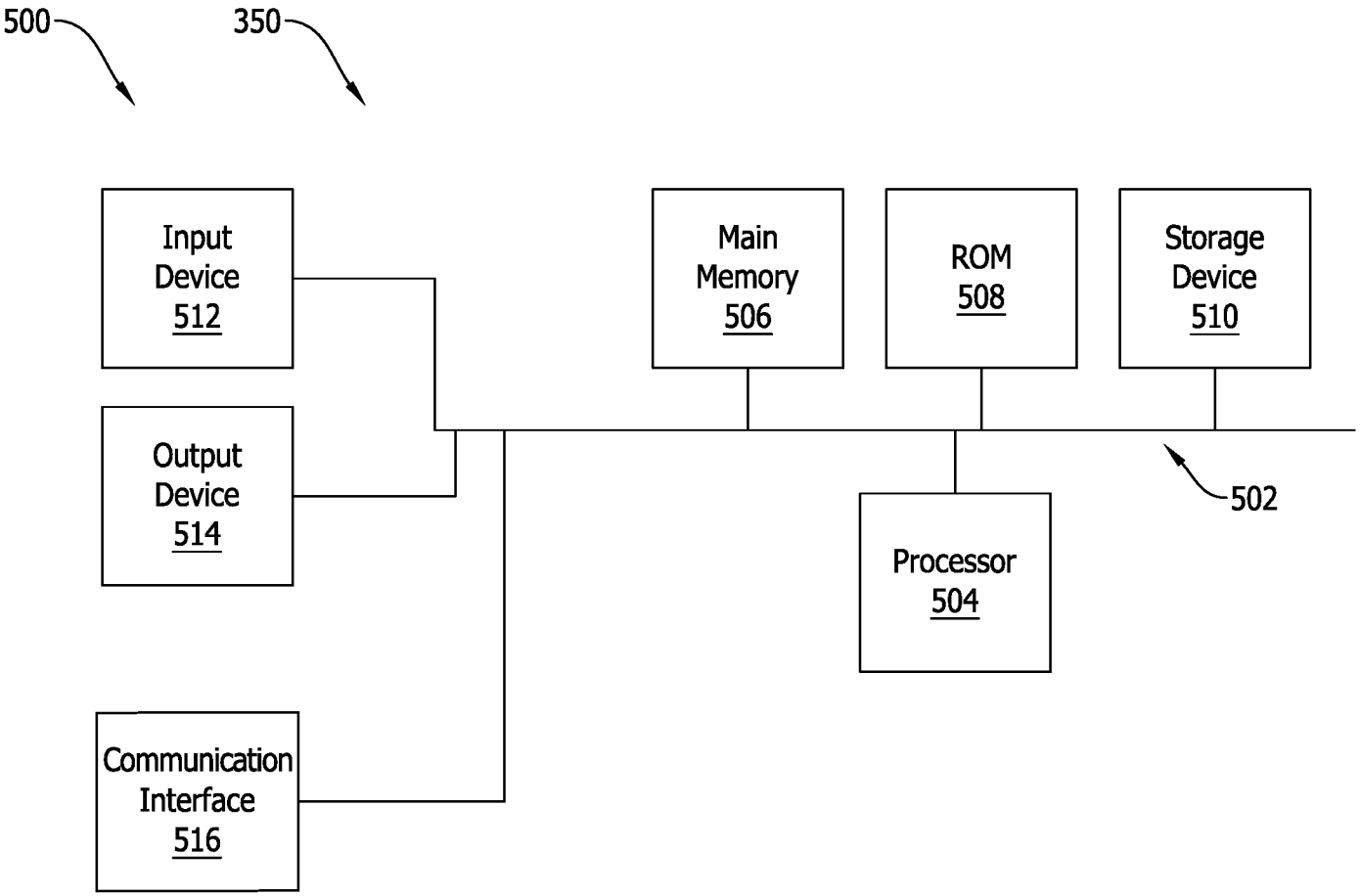
FIG. 5 is a block diagram of an example computing device that may be included in the communications satellite of FIG. 1.

FIG. 5 is a block diagram of an example computing device 500 that may be included in communications satellite 102 (FIG. 1). In some implementations, beamformer 350 includes computing device 500. Computing device 500 may include a bus 502, a processor 504, a main memory 506, a read only memory (ROM) 508, a storage device 510, an input device 512, an output device 514, and a communication interface 516. Bus 502 may include a path that permits communication among the components of computing device 500.

Processor 504 may include any type of conventional processor, microprocessor, or processing logic that interprets and executes instructions. Main memory 506 may include a random access memory (RAM) or another type of dynamic storage device that stores information and instructions for execution by processor 504. ROM 508 may include a conventional ROM device or another type of static storage device that stores static information and instructions for use by processor 504. Storage device 510 may include a magnetic and/or optical recording medium and its corresponding drive.

Input device 512 may include a conventional mechanism that permits computing device 500 to receive commands, instructions, or other inputs from a user, including visual, audio, touch, button presses, stylus taps, etc. Additionally, input device may receive location information. Accordingly, input device 512 may include, for example, a camera, a microphone, one or more buttons, and/or a touch screen. Output device 514 may include a conventional mechanism that outputs information to a user, including a display (including a touch screen) and/or a speaker. Communication interface 516 may include any transceiver-like mechanism that enables computing device 500 to communicate with other devices and/or systems. For example, communication interface 516 may include mechanisms for communicating with another device, such as phased array receiving antenna 300, communication sources 104, 106, 108 and/or other devices (not shown).

As described herein, computing device 500 facilitates mitigating interference from at least one interference source, such as interference source 110, at least by transmitting instructions to phase shifters 318, 320, 322, 324, 326, 328, 330, and 332 and attenuators 334, 336, 338, 340, 342, 344, 346, and 348 of phased array receiving antenna 300 to generate multiple composite beams 124 and 126, and determine a direction of a received interference signal 118 by cross-correlating first composite beam 124 and second composite beam 126. Computing device 500 may perform these and other operations in response to processor 504 executing software instructions contained in a computer-readable medium, such as memory 506. A computer-readable medium may be defined as a physical or logical memory device and/or carrier wave. The software instructions may be read into memory 506 from another computer-readable medium, such as data storage device 510, or from another device via communication interface 516. The software instructions contained in memory 506 may cause processor 504 to perform processes described herein. In other implementations, hardwired circuitry may be used in place of or in combination with software instructions to implement processes consistent with the subject matter herein. Thus, implementations consistent with the principles of the subject matter disclosed herein are not limited to any specific combination of hardware circuitry and software.

Figure 6:
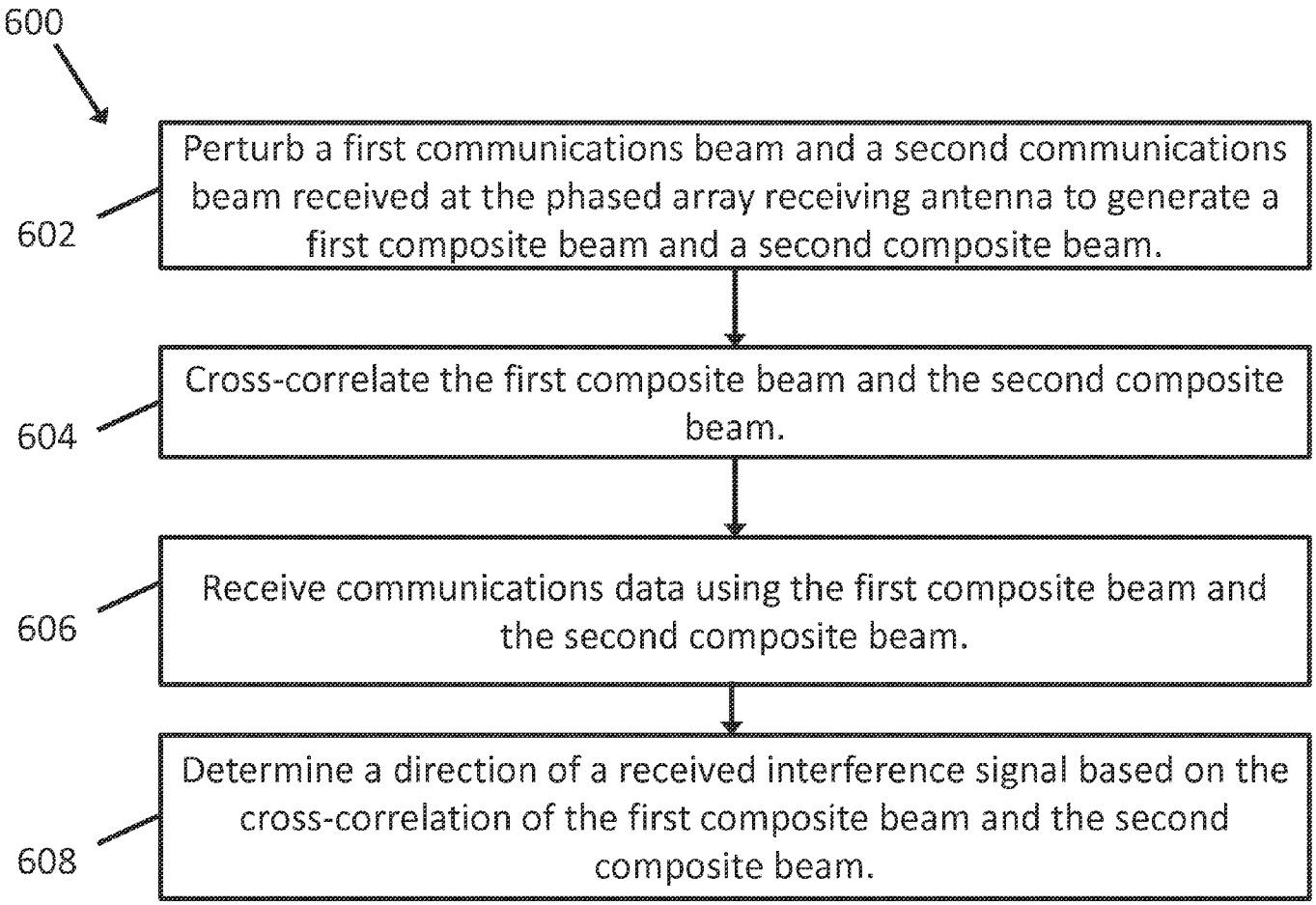
FIG. 6 is a high level flow chart of a process for mitigating interference that may be implemented by the communications satellite of FIG. 1.

FIG. 6 is a high level flow chart of a process 600 for mitigating interference that may be implemented by communications satellite 102 (FIG. 1). Initially, communications satellite 102 perturbs 602 first communications beam 112 and second communications beam 114 received at phased array receiving antenna 300 to generate first composite beam 124 and second composite beam 126. More specifically, communications satellite 102 generates first sub-beam 120, which together with first communications beam 112, forms first composite beam 124. Likewise, communications satellite 102 generates second sub-beam 122, which together with second communications beam 114, forms second composite beam 126. Additionally, communications satellite 102 cross-correlates 604 first composite beam 124 and second composite beam 126. Additionally, communications satellite 102 receives 606 communications data using first composite beam 124 and second composite beam 126. Additionally, communications satellite 102 determines 608 a direction of interference signal 118 received from interference source 110 based on the cross-correlation of first composite beam 124 and second composite beam 126. Reception 606 can occur concurrently with cross-correlation 604 and/or direction determination 608.

More specifically, in at least some implementations, communications satellite 102 receives communications data as described above concurrently with determining the direction of received interference signal 118. In other words, the perturbations to the beams, for example first communications beam 112 and second communications beam 114, are small enough to maintain sufficient link margin such that there are no communications service interruptions while determining the direction of interference signal 118 received from interference source 110 (i.e., "the geolocation process"). Accordingly, communications satellite 102 performs the geolocation process in the background as regular communications are in progress. In perturbing a communications beam, for example first communications beam 112, communications satellite 102 modifies a set of beamforming coefficients for a corresponding beamport, for example beamport 352, in a way that generates a sub-beam, for example sub-beam 120, under the base communications beam (e.g., first communications beam 112). This process may be referred to as "beam-under-beam processing." Beamport 352 then carries a superposition of the perturbed communications beam (e.g., first communications beam 112) and sub-beam 120 as a composite beam, for example first composite beam 124. Second composite beam 126 is generated in a similar manner.

In one example implementation, the sub-beam, for example first sub-beam 120, is of a fan-shaped type that is generated using one row (e.g., first row 478) or one column (e.g., first column 460) of phased array receiving antenna 300. The magnitude of first sub-beam 120 is lower than the magnitude of first communications beam 112 such that a link margin required to continue receiving communications data from first communications source 104 is maintained. First sub-beam 120 provides the necessary information for geolocation when used in conjunction with a second beamport (e.g. beamport 354) similarly configured with a second sub-beam (e.g., second sub-beam 122). Each beamport 352 and 354 steps through a predetermined set of directions for each corresponding sub-beam 120 and 122 and communications satellite 102 generates a covariance matrix. Each element of the covariance matrix encapsulates the cross-correlation between first sub-beam 120, which is pointed is a first direction and has a first orientation, and second sub-beam 122, which is pointed in a second direction and has a second orientation.

In another example implementation, a sub-beam, for example first sub-beam 120 is pseudo-random in nature and is generated by selective phase reversals of selected array elements along a periphery of phased array receiving antenna 300. As described above, array elements 400-407, 415-316, 302-314, and 408-448 form a periphery of phased array receiving antenna 300. Communications satellite 102 selects a subset of array elements 400-407, 415-316, 302-314, and 408-448 to generate first sub-beam 120 such that the link margin described above is maintained for receiving communications data from first communications source 104. Likewise, communications satellite 102 selects a subset of array elements 400-407, 415-316, 302-314, and 408-448 for generating second sub-beam while maintaining the link margin required for communications. The link margin may be predetermined as required for communications.

In another example implementation, communications satellite 102 replaces coefficients of first communications beam 112 with 1 s and −1 is in a checkerboard pattern with corresponding attenuators 334, 336, 338, 340, 342, 344, 346, 348 set at their maximum level to generate a low level sub-beam (e.g., first sub-beam 120) over a region of interest. Only one feed is excited, with low or no attenuation, to capture the signals of that feed. A similar process may be performed to generate second sub-beam 122. This implementation enables element-space processing using beamformer 350 and may be employed for a relatively short period of time interleaved with receiving communications data from communications source 104. The pattern of coefficients suppresses received signals for all but one feed.

In all of the above example implementations, the correlation between beamports 352 and 354 is computed. As described above, beamport 352 receives first composite beam 124 and beamport 354 receives second composite beam 126. Beamport 352 has two components: a first component that is formed by excitation coefficients for first communications beam 112 and a second component that is formed by excitation coefficients for first sub-beam 120. More specifically, the excitation coefficients used for first sub-beam 120 are replacement excitation coefficients to normal excitation coefficients used for first communications beam 112. The replacement excitation coefficients are applied to a subset of array elements of phased array receiving antenna 300, and thereby excite the subset of array elements, to form first sub-beam 120. Likewise, a similar process applies to second communications beam 114 and second sub-beam 122. Accordingly, beamport 354 has two components: a first component that is formed by excitation coefficients for second communications beam 114 and a second component that is formed by excitation coefficients for second sub-beam 122. In some implementations, phases of the replacement excitations are synchronously varied. Additionally, in some implementations, the subset of array elements used for first sub-beam 120 are disjoint from the subset of array elements used for second sub-beam 122. A desired correlation is between first sub-beam 120 and second sub-beam 122.

Communications satellite 102 may use the following process to extract the correlation: Let the signal of beamport 352 be S1=A+X, where A represents a signal of first communications beam 112 and X represents a signal of first sub-beam 120. Let the signal of beamport 354 be S2=B+Y, where B represents second communications beam 114 and Y represents second sub-beam 122. What is needed is the correlation between X and Y (i.e., <XY>). The direct correlation of beamports 352 and 354, <S1S2>, which is also representative of the correlation between first composite beam 124 and second composite beam 126, produces <AB>+<AY>+<XB>+<XY>. To extract <XY>, three additional correlations are formed by flipping the signs of the signals of sub-beams 120 and 122. In this manner, the following four correlations are formed: C1=<(A+X)(B+Y)>, C2=<(A+X)(B−Y)>, C3=<(A−X)(B+Y)>, and C4=<(A−X)(B−Y)>. After these measurements, <XY> is proportional to C1−C2−C3+C4. As previously mentioned, phases of the replacement excitations may be varied. Thus, for example, the process may include varying the phases of the first set of replacement excitations and varying the phases of the second set of replacement excitations through: normal first sub-beam excitations and normal second sub-beam excitations, normal first sub-beam excitations and inverted second sub-beam excitations, inverted first sub-beam excitations and inverted second sub-beam excitations, and inverted first sub-beam excitations and normal second sub-beam excitations.

In some implementations, in determining a direction of a received interference signal, such as interference signal 118, communications satellite 102 estimates an angle of arrival of interference signal 118. Also, in some implementations, in estimating the angle of arrival, communications satellite 102 geolocates interference signal 118 and/or interference source 110. Also, in some implementations, communications satellite 102 determines a pointing direction of phased array receiving antenna 300 based on the estimated angle of arrival. Additionally, in some implementations, communications satellite 102 determines a pointing direction of a spacecraft attitude based on the estimated angle of arrival.

In the above example implementations, only two beamports are used. However, because link performance is maintained for any beamports used for geolocation, additional beams can optionally be used without affecting system resources. If more beamports are allocated to this process, the covariance matrix can be computed faster and more accurately, resulting in an alternative implementation that improves geolocation cycle time at the expense of additional processing complexity.

A technical effect of systems and methods described herein includes at least one of: (a) perturbing a first communications beam and a second communications beam received at a phased array receiving antenna to generate a first composite beam and a second composite beam; (b) cross-correlating the first composite beam and the second composite beam; (c) receiving communications data using the first composite beam and the second composite beam; and (d) determining a direction of a received interference signal based on the cross-correlation of the first composite beam and the second composite beam.

As compared to known methods and systems for geolocating or otherwise mitigating a source of an interference signal, the methods and systems described herein facilitate geolocating or otherwise mitigating a source of an interference signal received at a communications satellite while enabling communication service to continue through the communications satellite.

The description of the different advantageous implementations has been presented for purposes of illustration and description, and is not intended to be exhaustive or limited to the implementations in the form disclosed. Many modifications and variations will be apparent to those of ordinary skill in the art. Further, different advantageous implementations may provide different advantages as compared to other advantageous implementations. The implementation or implementations selected are chosen and described in order to best explain the principles of the implementations, the practical application, and to enable others of ordinary skill in the art to understand the disclosure for various implementations with various modifications as are suited to the particular use contemplated. This written description uses examples to disclose various implementations, which include the best mode, to enable any person skilled in the art to practice those implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for geolocating an interference signal using a phased array receiving antenna, said method comprising:

perturbing a first communications beam and a second communications beam received at the phased array receiving antenna to generate a first sub-beam from the first communications beam and a second sub-beam from the second communications beam, wherein the first communications beam and the first sub-beam form a first composite beam and the second communications beam and the second sub-beam form a second composite beam;

cross-correlating the first composite beam and the second composite beam;

receiving communications data using the first composite beam and the second composite beam; and determining a direction of a received interference signal based on the cross-correlation of the first composite beam and the second composite beam.

2. The method of claim 1, wherein said receiving communications data and said determining a direction of a received interference signal are performed concurrently.

3. The method of claim 1, wherein cross-correlating the first composite beam and the second composite beam further comprises generating a covariance matrix that encapsulates a cross-correlation between a first direction and a first orientation of the first sub-beam and a second direction and a second orientation of the second sub-beam.

4. The method of claim 1, wherein perturbing the first communications beam and the second communications beam comprises:

selecting a first subset of array elements of the phased array antenna;

replacing a first set of excitations of the selected first subset of array elements with a first set of replacement excitations, wherein phases of the first set of replacement excitations are synchronously varied;

exciting the first subset of array elements with the first set of replacement excitations, thereby generating the first sub-beam of the first composite beam;

selecting a second subset of array elements of the phased array antenna;

replacing a second set of excitations of the selected second subset of array elements with a second set of replacement excitations, wherein phases of the second set of replacement excitations are synchronously varied; and exciting the second subset of array elements with the second set of replacement excitations, thereby generating the second sub-beam of the second composite beam.

5. The method of claim 4, wherein selecting the first subset and selecting the second subset further comprises selecting the first subset and selecting the second subset such that the first subset and the second subset are disjoint.

6. The method of claim 4, wherein selecting the first subset and selecting the second subset further comprises selecting the first subset and selecting the second subset while maintaining a predetermined link margin required for communication.

7. The method of claim 4, further comprising varying the phases of the first set of replacement excitations and varying the phases of the second set of replacement excitations through: normal first sub-beam excitations and normal second sub-beam excitations, normal first sub-beam excitations and inverted second sub-beam excitations, inverted first sub-beam excitations and inverted second sub-beam excitations, and inverted first sub-beam excitations and normal second sub-beam excitations.

8. The method of claim 4, wherein generating the first sub-beam comprises generating a fan beam.

9. The method of claim 4, wherein selecting a first subset of array elements of the phased array antenna further comprises selecting a first subset of array elements along a periphery of the phased array antenna.

10. The method of claim 1, wherein said determining a direction of a received interference signal further comprises estimating an angle of arrival.

11. The method of claim 10, further comprising geolocating the received interference signal based on the estimated angle of arrival.

12. The method of claim 10, further comprising determining a pointing direction of the phased array receiving antenna based on the estimated angle of arrival.

13. The method of claim 10, further comprising determining a pointing direction of a spacecraft attitude based on the estimated angle of arrival.

14. A communications satellite comprising:

a phased array receiving antenna; and at least one processor in communication with said phased receiving antenna, said at least one processor configured to:

perturb a first communications beam and a second communications beam received at said phased array receiving antenna to generate a first sub-beam from the first communications beam and a second sub-beam from the second communications beam, wherein the first communications beam and the first sub-beam form a first composite beam and the second communications beam and the second sub-beam form a second composite beam;

cross-correlate the first composite beam and the second composite beam;

receive communications data using the first composite beam and the second composite beam; and determine a direction of a received interference signal based on the cross-correlation of the first composite beam and the second composite beam.

15. The communications satellite of claim 14, wherein said phased array receiving antenna comprises a plurality of array elements, and wherein said at least one processor is further configured to perturb the first communications beam and the second communications beam by:

selecting a first subset of said array elements;

replacing a first set of excitations of the selected first subset of said array elements with a first set of replacement excitations, wherein phases of the first set of replacement excitations are synchronously varied;

exciting the first subset of said array elements with the first set of replacement excitations, thereby generating the first sub-beam of the first composite beam;

selecting a second subset of said array elements;

replacing a second set of excitations of the selected second subset of said array elements with a second set of replacement excitations, wherein phases of the second set of replacement excitations are synchronously varied; and exciting the second subset of said array elements with the second set of replacement excitations, thereby generating the second sub-beam of the second composite beam.

16. The communications satellite of claim 15, further configured to select the first subset and select the second subset by selecting the first subset and selecting the second subset such that the first subset and the second subset are disjoint.

17. The communications satellite of claim 15, further configured to select the first subset and select the second subset by selecting the first subset and selecting the second subset while maintaining a predetermined link margin required for communication.

18. The communications satellite of claim 15, further configured to vary the phases of the first set of replacement excitations and vary the phases of the second set of replacement excitations through: normal first sub-beam excitations and normal second sub-beam excitations, normal first sub-beam excitations and inverted second sub-beam excitations, inverted first sub-beam excitations and inverted second sub-beam excitations, and inverted first sub-beam excitations and normal second sub-beam excitations.

19. The communications satellite of claim 14, further configured to cross-correlate the first composite beam and the second composite beam by generating a covariance matrix that encapsulates a cross-correlation between a first direction and a first orientation of the first sub-beam and a second direction and a second orientation of the second sub-beam.

20. A non-transitory computer-readable medium having computer-executable instructions embodied thereon, wherein when executed by a communications satellite comprising a phased array receiving antenna and at least one processor in communication with the phased array receiving antenna, the computer-executable instructions cause the at least one processor to:

perturb a first communications beam and a second communications beam received at the phased array receiving antenna to generate a first sub-beam from the first communications beam and a second sub-beam from the second communications beam, wherein the first communications beam and the first sub-beam form a first composite beam and the second communications beam and the second sub-beam form a second composite beam;

cross-correlate the first composite beam and the second composite beam;

receive communications data using the first composite beam and the second composite beam; and determine a direction of a received interference signal based on the cross-correlation of the first composite beam and the second composite beam.

* * * * *